US005826508A

United States Patent [19]

Komori

[11] Patent Number: 5,826,508

[45] Date of Patent: Oct. 27, 1998

[54] INKING APPARATUS FOR PRINTING PRESS

[75] Inventor: Tatsuo Komori, Ibaragi, Japan

[73] Assignee: Komori Corporation, Tokyo, Japan

[21] Appl. No.: 902,500

[22] Filed: Jul. 29, 1997

[30] Foreign Application Priority Data

Jul. 31, 1996 [JP] Japan ..... 8-201768

[51] Int. Cl.[6] ..... B41F 31/06; B41F 31/14; B41F 31/15

[52] U.S. Cl. ..... 101/350.3; 101/351.3; 101/DIG. 32; 101/DIG. 38

[58] Field of Search ..... 101/350.1, 350.3, 101/351.3, 352.04, 352.06, 352.09, DIG. 32, DIG. 38, 148

[56] References Cited

U.S. PATENT DOCUMENTS

| | | | |
|---|---|---|---|
| 3,003,416 | 10/1961 | Grobman | 101/350 |
| 3,041,968 | 7/1962 | Moser et al. | 101/365 |
| 3,765,328 | 10/1973 | Treff et al. | 101/349 |
| 4,223,603 | 9/1980 | Faddis et al. | 101/138 |
| 4,524,692 | 6/1985 | Rodvelt | 101/350 |
| 5,107,761 | 4/1992 | Greive | 101/148 |
| 5,566,613 | 10/1996 | Stoffler et al. | 101/30 |

FOREIGN PATENT DOCUMENTS

| | | |
|---|---|---|
| 0 696 503 | 7/1995 | European Pat. Off. . |
| 56-120352 | 9/1981 | Japan . |
| 4-39008 | 9/1992 | Japan . |

*Primary Examiner*—J. Reed Fisher
*Attorney, Agent, or Firm*—Blakely Sokoloff Taylor & Zafman

[57] ABSTRACT

An inking apparatus for a printing press includes an ink supplying unit, an ink form roller, an oscillating roller, and an ink ductor roller. The ink supplying unit has an ink fountain for storing an ink, and an ink fountain roller having a circumferential surface on which a film of the ink supplied from the ink fountain is formed. The ink supplying unit supplies the ink on the circumferential surface of the ink fountain roller to an ink transfer line for a plate cylinder. The ink form roller supplies the ink, supplied from the ink supplying unit through the ink transfer line, to a plate mounted on the plate cylinder. The oscillating roller is disposed along the ink transfer line between the ink fountain roller and the ink form roller to reciprocally move in an axial direction. The ink ductor roller reciprocally moves between a position for coming into contact with an upstream-side roller in an ink transfer direction to receive the ink, and a position for coming into contact with a downstream-side roller in the ink transfer direction to transfer the ink. The oscillating roller and the ink ductor roller have different periods of motion.

7 Claims, 6 Drawing Sheets

INKING APPARATUS FOR PRINTING PRESS

BACKGROUND OF THE INVENTION

The present invention relates to an inking apparatus for a printing press having an upstream-side roller in the ink transfer direction, a downstream-side roller in the ink transfer direction, and an ink ductor roller interposed between these two rollers.

FIG. 5 schematically shows an inking apparatus 1 for a general printing press. Referring to FIG. 5, a plate cylinder 2 is axially supported by a pair of right and left frames (not shown). A printing plate is mounted on the circumferential surface of the plate cylinder 2. A pair of ink form rollers 4 supported by a pair of oscillating rollers 3 through arms detachably oppose the surface of the plate cylinder 2 to come into contact with it. Three ink distribution rollers 5 are arranged above the oscillating rollers 3 to bridge the oscillating rollers 3 such that they oppose the circumferential surfaces of each other to come into contact with them. An oscillating roller 6 opposes one of these ink distribution rollers 5 to come into contact with it.

A roller group consisting of the oscillating rollers 3 and 6, the ink form rollers 4, and the ink distribution rollers 5 disposed in this manner, and an ink supplying unit 7 (to be described later) constitutes the inking apparatus 1. The ink supplying unit 7 has an ink fountain roller 10 which is connected to the drive system of the plate cylinder 2, and the oscillating rollers 3 and 6, and the like and driven by it, so that it intermittently rotates at a low speed. The circumferential surface of the ink fountain roller 10, an ink blade 11, and right and left ink dams 12 constitute an ink fountain 13 that stores an ink 14.

Between the ink fountain roller 10 and the oscillating roller 6, an oscillating roller 15 is axially supported by the right and left frames through bearings to be reciprocally movable in the axial direction. An ink ductor roller 16 is arranged between the oscillating roller 15 and the ink fountain roller 10. The ink ductor roller 16 reciprocally moves between the two rollers 10 and 15 while coming into contact with them alternately. An ink distribution roller 17 is disposed between the oscillating roller 6 and the oscillating roller 15. The circumferential surface of the ink distribution roller 17 opposes the two rollers 6 and 15 to come into contact with them.

In the inking apparatus having the above arrangement, the ink 14 stored in the ink fountain 13 flows out from a gap between the circumferential surface of the ink fountain roller 10 and the ink blade 11, and is carried by the ink fountain roller 10 which rotates in the direction of an arrow in FIG. 5, to form an ink film on the circumferential surface of the ink fountain roller 10. This ink film is transferred to the oscillating roller 15 by the ink ductor roller 16 that reciprocally moves between the ink fountain roller 10 and the oscillating roller 15, is uniformed in the respective directions while it is sequentially transferred by the ink distribution roller 17, the oscillating roller 6, and the oscillating rollers 3, and is supplied to the plate surface of the plate cylinder 2 by the ink form rollers 4.

The ink blade 11 is divided into a plurality of sections in the axial direction of the ink fountain roller 10. The gaps between the sections of the ink blade 11 and the circumferential surface of the ink fountain roller 10 can be adjusted individually. In order to uniform the density of the ink in the widthwise direction of printing paper, the gap between the ink blade 11 and the circumferential surface of the ink fountain roller 10 is set to be constant throughout the entire length of the ink fountain roller 10 in the axial direction. The thickness of the film of the ink flowing out from the gap between the circumferential surface of the ink fountain roller 10 and the ink blade 11 is uniformed in the axial direction of the ink fountain roller 10. The thickness of the ink film is further adjusted by referring to this uniform thickness.

Even though the gap between the ink blade 11 and the circumferential surface of the ink fountain roller 10 is set to be constant throughout the entire length of the ink fountain roller 10 in the axial direction in this manner, as the printing press is operated, an ink density difference occurs in the widthwise direction of the paper, that is, between the right and left sides of the paper, as indicated by a straight line a in FIG. 6. In order to set constant the density of the ink in the widthwise direction of the paper, as indicated by a straight line b in FIG. 6, fine adjustment for increasing the gap between the right portion of the ink blade 11 and the circumferential surface of the ink fountain roller 10, where the density is small, to be larger than that on the left side must be repeated a number of times, leading to a cumbersome adjusting operation.

Since an ink density difference occurs in the widthwise direction of the paper, it is difficult to use an image area rate reading unit which reads the image area rate of the plate mounted on the surface of the plate cylinder 2 and controls the amount of ink supplied to the inking apparatus 1 based on the read data.

The present applicant repeatedly conducted various experiments to find that cause for this ink density difference in the widthwise direction of the paper, and reached an assumption that this was because the period of motion of the oscillating roller 15 that reciprocally moved in the axial direction at a predetermined period and the period of motion of the ink ductor roller 16 that reciprocally moved between the ink fountain roller 10 and the oscillating roller 15 at a predetermined period coincided with each other. More specifically, as shown in FIG. 7, in the conventional inking apparatus, both the period during which the oscillating roller 15 reciprocally moves once in the axial direction and the period during which the ink ductor roller 16 reciprocally moves once between the two rollers 10 and 15 coincide with the period during which the plate cylinder 2 rotates by one revolution.

For this reason, the timing at which ink ductor roller 16 comes into contact with the oscillating roller 15 is always a timing when the phase of the oscillating roller 15 is located on either one of right and left ends (right end in FIG. 7) of the paper. The ink ductor roller 16 which comes into contact with the oscillating roller 15 is located at the center of oscillation width of the oscillating roller 15, and a width L of the oscillating roller 15 corresponds to the length between the left end of the oscillating roller 15 when its phase is located at the right end and the right end of the oscillating roller 15 when its phase is located at the left end.

In the conventional case wherein the oscillating roller 15 always comes into contact with the ink ductor roller 16 when its phase is located at the right end, the ink is transferred only from the center to the left end side of the oscillating roller 15. The hatched portions indicate the ink transferred to the circumferential surface of the oscillating roller 15. Another one revolution of the plate cylinder 2, and the phase of the oscillating roller 15 is located at the left end, and a larger amount of ink is transferred from the oscillating roller 15, which has moved to the left side, to the left side of the ink distribution roller 17, which opposes the oscillating roller 15 to come into contact with it, than to the right side of the ink distribution roller 17. The ink which is locally transferred to the left end side of the circumferential surface of the ink distribution roller 17 is uniformed to a certain degree by the oscillating rollers 6 and 3 in the axial direction of the rollers. However, as continuous printing is performed, the ink is sequentially accumulated on the left end side of the circumferential surface of the ink distribution roller 17. The locally accumulated ink cannot be completely uniformed even with the oscillating rollers 6 and 3. This is assumed to be the factor that causes the ink density difference between the right and left sides of the paper.

SUMMARY OF THE INVENTION

It is an object of the present invention to provide an inking apparatus for a printing press which can easily adjust the ink density.

In order to achieve the above object, according to the present invention, there is provided an inking apparatus for a printing press, comprising an ink supplying unit having an ink fountain for storing an ink and an ink fountain roller having a circumferential surface on which a film of the ink supplied from the ink fountain is formed, the ink supplying unit being adapted to supply the ink on the circumferential surface of the ink fountain roller to an ink transfer line for a plate cylinder, an ink form roller for supplying the ink, supplied from the ink supplying unit through the ink transfer line, to a plate mounted on the plate cylinder, an oscillating roller disposed along the ink transfer line between the ink fountain roller and the ink form roller to reciprocally move in an axial direction, and an ink ductor roller for reciprocally moving between a position for coming into contact with an upstream-side roller in an ink transfer direction to receive the ink and a position for coming into contact with a downstream-side roller in the ink transfer direction to transfer the ink, the oscillating roller and the ink ductor roller having different periods of motion.

DESCRIPTION OF THE PREFERRED EMBODIMENTS

The present invention will be described in detail with reference to the accompanying drawings.

Figure 1:
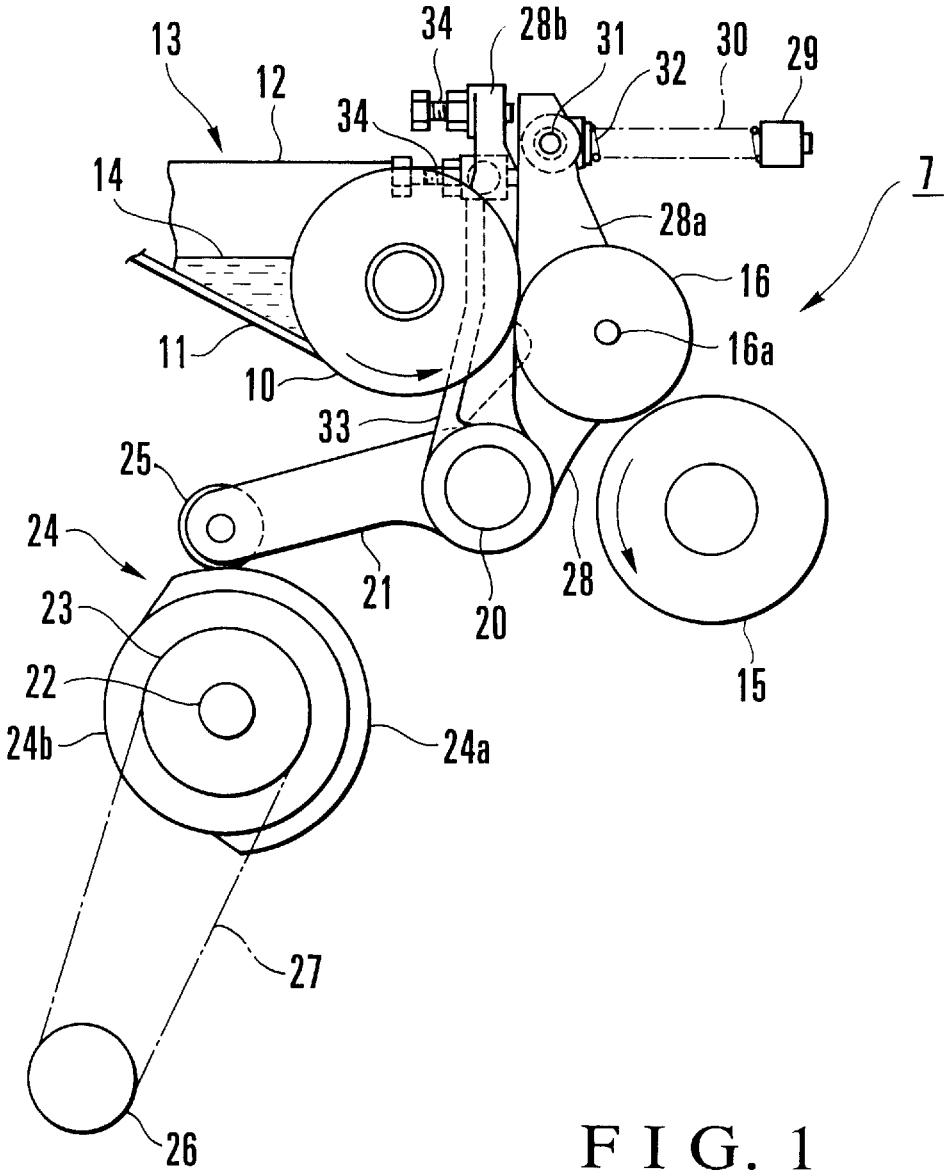
FIG. 1 is a side view showing the main part of an inking apparatus for a printing press according to the first embodiment of the present invention.
Figure 5:
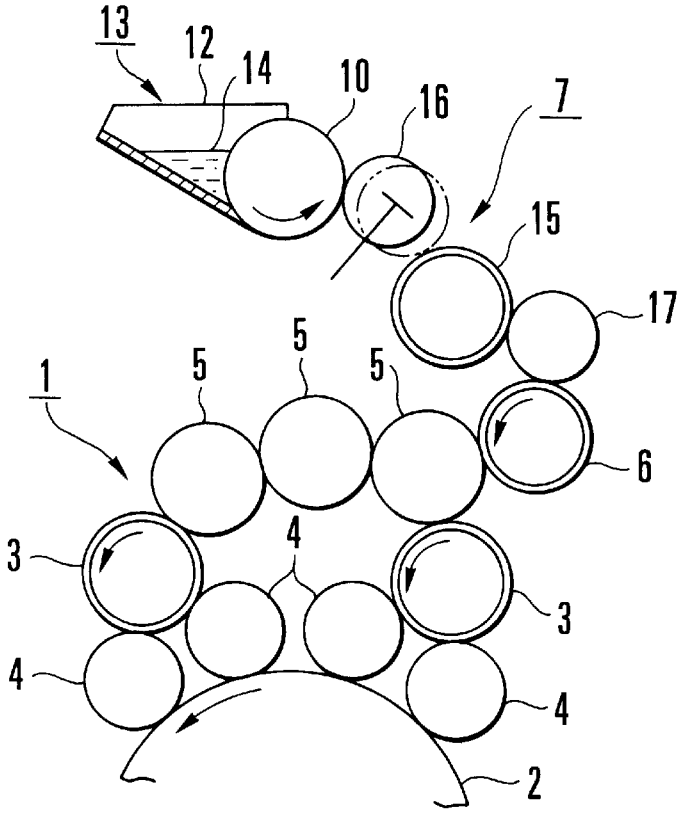
FIG. 5 is a side view showing the schematic arrangement of an inking apparatus for a general printing press.
Figure 6:
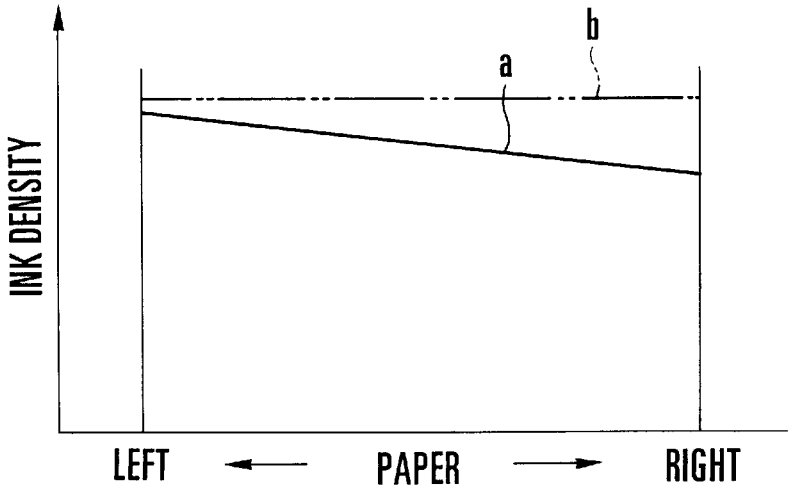
FIG. 6 PRIOR ART
FIG. 6 is a graph showing the ink density on the right and left sides of paper obtained by a conventional inking apparatus.
Figure 7:
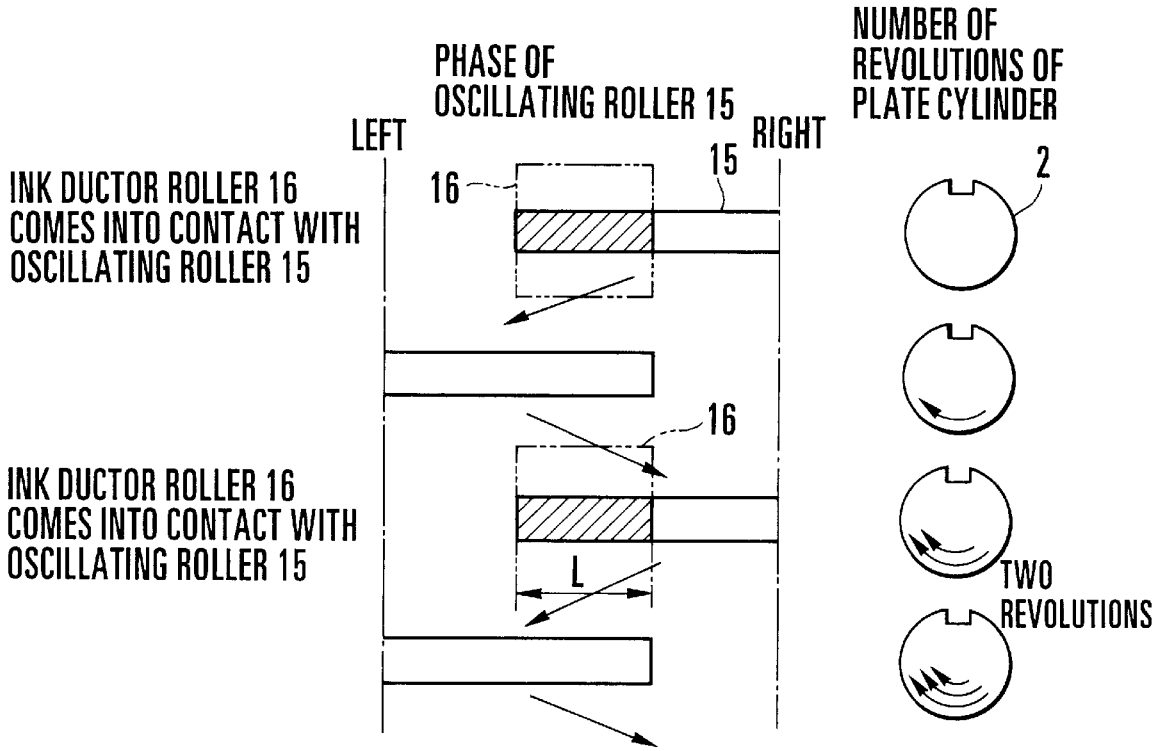
F I G. 7 PRIOR ART
FIG. 7 is a view showing the relationship in phase between the ink ductor roller and the oscillating roller of the conventional inking apparatus.

FIG. 1 shows the main part of an inking apparatus for a printing press according to the first embodiment of the present invention, and corresponds to the enlarged ink supplying unit portion shown in FIG. 5. This embodiment will be described with reference to FIGS. 1 and 5. In an ink supplying unit 7, an ink ductor shaft 20 serving as the fulcrum of swing of an ink ductor roller 16 is pivotally, axially supported between an ink fountain roller 10 and an oscillating roller 15 by right and left frames (not shown). An ink 14 stored in an ink fountain 13 is supplied to the ink fountain roller 10 to form an ink film on its circumferential surface. One end of the ink ductor shaft 20 projects from the frame, and a cam lever 21 is integrally formed with this projecting portion. The ink fountain roller 10 corresponds to the upstream-side roller in the ink transfer direction, and the oscillating roller 15 corresponds to the downstream-side roller in the ink transfer direction.

Obliquely under the ink ductor shaft 20, a cam shaft 22 extends upward from the frame, and a sprocket 23 and a cam 24 are axially supported on the cam shaft 22 to be integrally rotatable. The cam 24 has a cam surface constituted by a large-diameter portion 24*a* and a small-diameter portion 24*b*, and a cam follower 25 at the distal end portion of the cam lever 21 abuts against this cam surface. A drive sprocket 26 is arranged below the sprocket 23. Rotation of a motor that drives a plate cylinder 2 shown in FIG. 5 to rotate is transmitted to the sprocket 26 shown in FIG. 1, as will be described later, to rotate it by one revolution while the plate cylinder 2 rotates by one revolution. The sprockets 23 and 26 are connected to each other through a chain 27. A pair of right and left swing levers 28 are integrally fixed to the ink ductor shaft 20 to be located on the inner sides of the pair of frames. The ink ductor roller 16 is axially supported at central portions 28*a* of the swing levers 28 to be rotatable together with its two end shafts 16*a*.

Upper end portions 28*b* of the swing levers 28 extend farther upward from the central portions 28*a*, and spring shafts 30 each having one end supported by a spring receptacle 29 extending from the frame are pivotally mounted on the upper end portions 28*b*. Compression coil springs 32 which apply a pivot force to the respective swing levers 28 counterclockwise, i.e., in such a direction that the ink ductor roller 16 comes close to the ink fountain roller 10, are respectively mounted on the spring shafts 30. Stop levers 33 are axially mounted upright on the ink ductor shaft 20 to be close to the respective swing levers 28. Stoppers 34 are arranged on the upper end portions of the respective stop levers 33. The stoppers 34 regulate swing of the swing levers 28 toward the ink fountain roller 10, thus moderating the collision of the ink ductor roller 16 with the ink fountain roller 10.

The two sprockets 23 and 26 have, e.g., 30 teeth and 10 teeth, respectively, i.e., a gear ratio of 3:1. While the plate cylinder 2 rotates by one revolution, the sprocket 23 rotates about the cam shaft 22 by a ⅓ revolution in accordance with this gear ratio. Accordingly, while the plate cylinder 2 rotates by three revolutions, the sprocket 23 rotates by one revolution, and the cam 24 also rotates by one revolution. While the cam 24 rotates by one revolution, the cam follower 25 moves along the cam surface constituted by the large-diameter portion 24*a* and the small-diameter portion 24*b*, and the cam lever 21 swings once about the ink ductor shaft 20 as the swing center. As the cam lever 21 swings, the ink ductor shaft 20 pivots, and the swing levers 28 integral with the ink ductor shaft 20 also swing. Hence, the ink ductor roller 16 supported by the swing levers 28 reciprocally moves once between the ink fountain roller 10 and the oscillating roller 15 to come into contact with them alternately.

Figure 2:
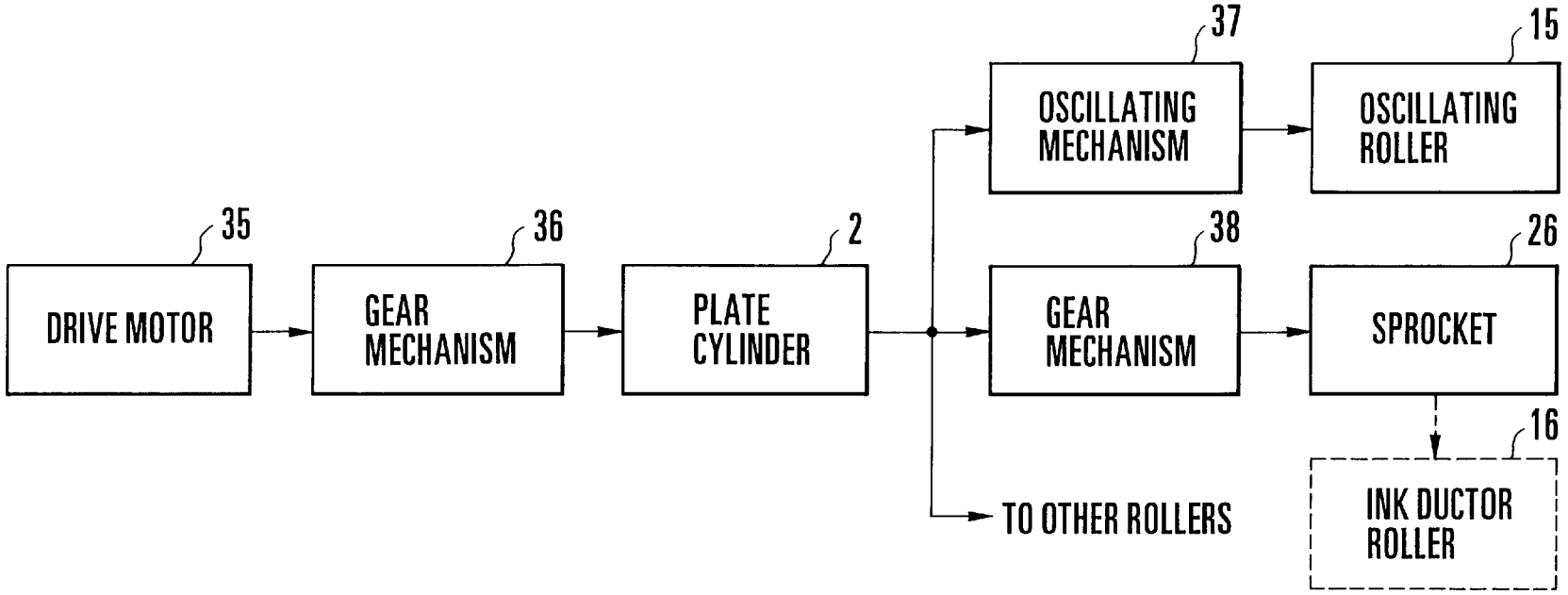
FIG. 2 is a view showing the drive system of the inking apparatus shown in FIG. 1.

FIG. 2 shows how the oscillating roller 15 and the sprocket 26 are commonly driven by one drive motor 35. Referring to FIG. 2, rotation of the drive motor 35 is transmitted to the plate cylinder 2 through a gear mechanism 36, and the plate cylinder 2 is then driven to rotate. Rotation of the plate cylinder 2 is transmitted through a gear mechanism 38 to the sprocket 26 which reciprocally drives the ink ductor roller 16, so that the sprocket 26 is driven to rotate. Rotation of the plate cylinder 2 is further converted into reciprocal motion by a known ink oscillating mechanism 37, as indicated by, e.g., Japanese Utility Model Publication No. 4-39008, to reciprocally drive the oscillating roller 15 in the axial direction. The oscillating roller 15 and the sprocket 26 may be driven by the drive motor 35 directly through an ink oscillating mechanism and a gear mechanism.

In this arrangement, as described above, during three revolutions of the plate cylinder 2, the sprocket 26 rotates by three revolutions, and during three revolutions of the sprocket 26, the ink ductor roller 16 reciprocally moves once between the rollers 10 and 15. Meanwhile, during two revolutions of the plate cylinder 2, the oscillating roller 15 reciprocally moves once in the axial direction. That is, during two revolutions of the plate cylinder 2, the oscillating roller 15 reciprocally moves only once in the axial direction, and during three revolutions of the plate cylinder 2, the ink ductor roller 16 reciprocally moves only once between the rollers 10 and 15.

The ink density adjusting operation of the inking apparatus having the above arrangement will be described. First, an ink blade 11 divided into sections is adjusted so that the gap between the ink blade 11 and the circumferential surface of the ink fountain roller 10 is set to be constant throughout the entire length of the ink fountain roller 10 in the axial direction. Then, when the printing press is driven to rotate, an ink 14 flows out every predetermined amount from the gap between the ink fountain roller 10 and the ink blade 11. The ink film formed on the surface of the ink fountain roller 10 is transferred to the oscillating roller 15 by the ink ductor roller 16. The ink transferred to the oscillating roller 15 is uniformed in the respective directions while it is sequentially transferred by an ink distribution roller 17, an oscillating roller 6, and oscillating rollers 3, and is finally supplied by ink form rollers 4 to the plate mounted on the plate cylinder 2.

Figure 3:
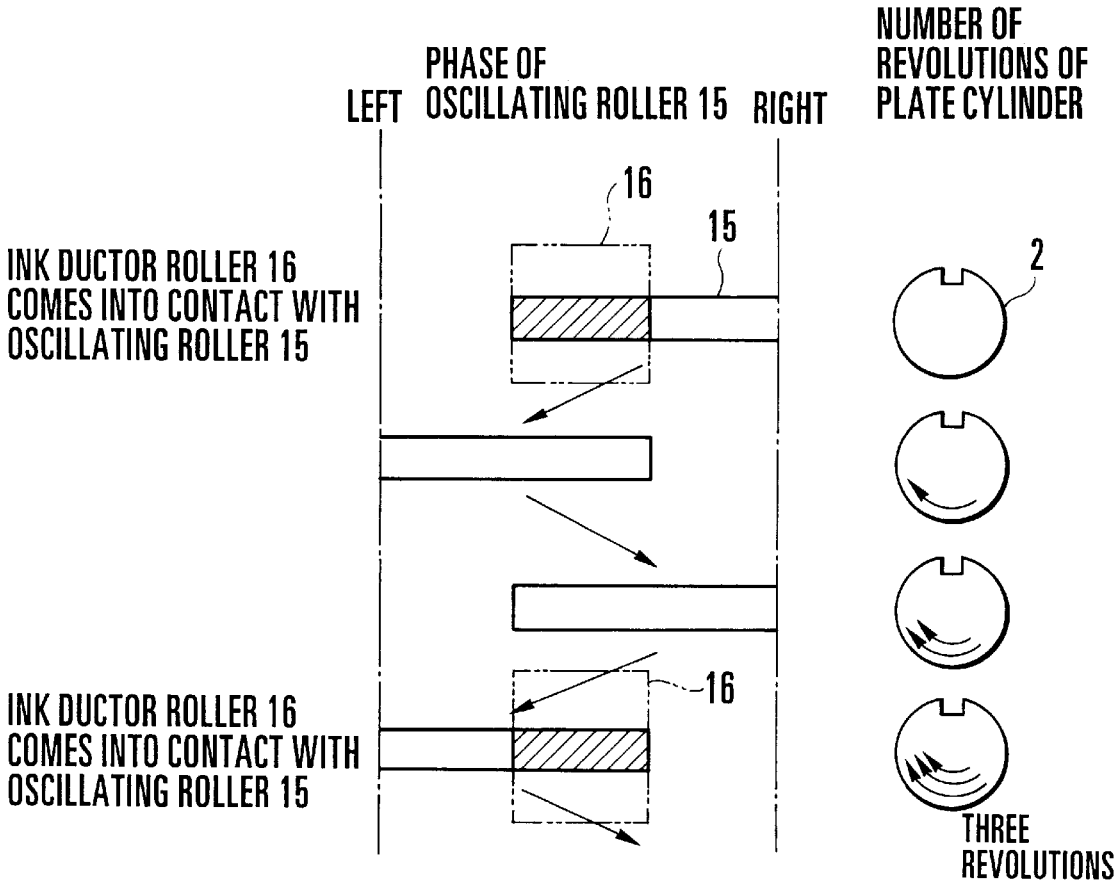
FIG. 3 is a view showing the relationship in phase between the ink ductor roller and the oscillating roller of the inking apparatus shown in FIG. 1.

At this time, during three revolutions of the plate cylinder 2, the ink ductor roller 16 reciprocally moves once between the ink fountain roller 10 and the oscillating roller 15, whereas during two revolutions of the plate cylinder 2, the oscillating roller 15 reciprocally moves once in the axial direction. Accordingly, as shown in FIG. 3, assume that the ink ductor roller 16 comes into contact with the oscillating roller 15 when the oscillating roller 15 is located at the right end in the axial direction. The ink ductor roller 16 comes into contact with the oscillating roller 15 again when the plate cylinder 2 rotates by three revolutions and the oscillating roller 15 is located at the left end.

In this manner, during two revolutions, i.e., even-numbered revolutions, of the plate cylinder 2, the oscillating roller 15 is reciprocally moved once, and during three revolutions, i.e., odd-numbered revolutions, of the plate cylinder 2, the ink ductor roller 16 is reciprocally moved once, so that the ink ductor roller 16 alternately comes into contact with the oscillating roller 15 when located at the right end position and located at the left end position. For this reason, the amount of ink transferred from the oscillating roller 15 to the circumferential surface of the ink distribution roller 17 becomes uniform in the axial direction of the ink distribution roller 17. More specifically, after the ink is transferred from the ink ductor roller 16 to the oscillating roller 15 located at the right end position, the oscillating roller 15 transfers the ink to the ink distribution roller 17 that opposes it to come into contact with it while moving to the left end side. Therefore, the amount of ink transferred to the circumferential surface of the ink distribution roller 17 gradually increases from the right end side to the left end side.

After the ink is transferred from the ink ductor roller 16 to the oscillating roller 15 located at the left end position, the oscillating roller 15 transfers the ink to the ink distribution roller 17 that opposes it to come into contact with it while moving to the right end side. For this reason, the amount of ink transferred to the circumferential surface of the ink distribution roller 17 gradually increases from the left end side to the right end side. When the ink is transferred in a large amount to the right and left ends of the ink distribution roller 17 alternately in this manner, the difference in ink amount between the right and left ends is canceled, and the amount of ink transferred to the circumferential surface of the ink distribution roller 17 becomes axially symmetric with respect to the axial direction of the ink distribution roller 17, thus being substantially uniformed.

The ink transferred to the circumferential surface of the ink distribution roller 17 to be axially symmetric is sequentially transferred to the oscillating roller 6 and the oscillating rollers 3, and is then supplied by the ink form rollers 4 to the plate mounted on the plate cylinder 2. The ink supplied to the plate has a uniform ink film thickness between the right and left sides of the plate. Therefore, an ink density difference does not occur between the right and left sides of printed paper.

According to the first embodiment, once the gap between the ink blade 11 and the circumferential surface of the ink fountain roller 10 is adjusted to be constant throughout the entire length of the ink fountain roller 10 in the axial direction, an ink density difference does not occur in the widthwise direction of the paper. As a result, gap adjustment between the ink blade 11 and the circumferential surface of the ink fountain roller 10 need be performed only once, greatly facilitating the adjusting operation. Since the relationship between the gap between the ink blade 11 and the circumferential surface of the ink fountain roller 10 and the density of the ink transferred to the paper becomes constant throughout the entire width of the paper without any change, optimum ink supply in accordance with the image can be performed based on data from the image area rate reading unit.

In the first embodiment, since the frequency of the reciprocating motion of the ink ductor roller 16 is not excessively increased preferably, a case has been described above wherein the ink ductor roller 16 is reciprocally moved once during three revolutions of the plate cylinder 2 as an example of odd-number revolutions. However, the ink ductor roller 16 can be reciprocally moved once during one revolution of the plate cylinder 2, as a matter of course.

Figure 4:
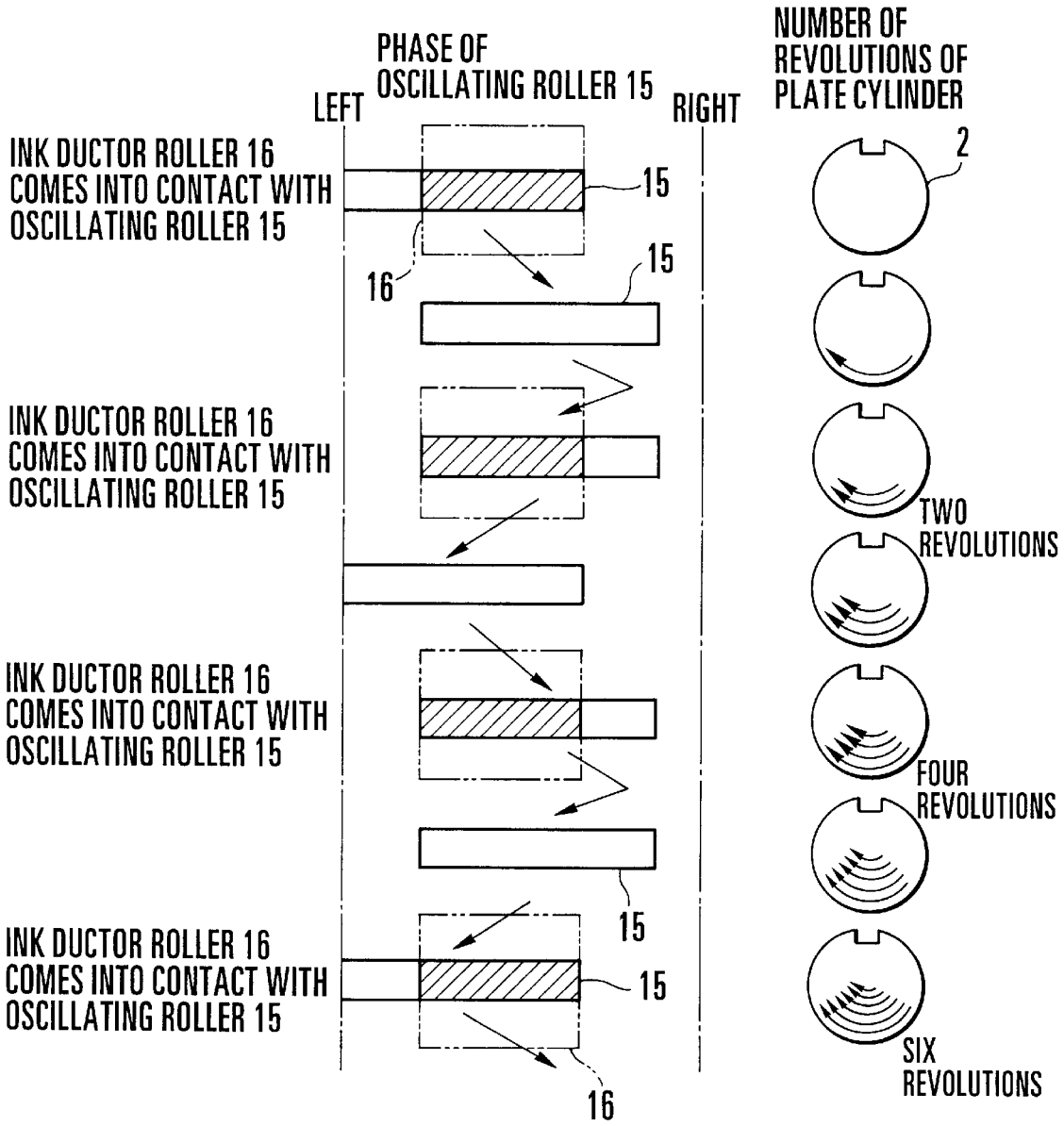
FIG. 4 is a view showing the relationship in phase between the ink ductor roller and the oscillating roller of the second embodiment of the present invention.

FIG. 4 shows the relationship in phase between the oscillating roller and the ink ductor roller of the second embodiment of the present invention. In this second embodiment, during two revolutions of a plate cylinder 2, an ink ductor roller 16 reciprocally moves once between an ink fountain roller 10 and an oscillating roller 15, and during three revolutions of the plate cylinder 2, the oscillating roller 15 reciprocally moves once to the right and left in the axial direction. The oscillating roller 15 is located at the right end between the first and second revolutions, and between the fourth and fifth revolutions of the plate cylinder 2. More specifically, while the plate cylinder 2 is rotating for the first revolution or the fourth revolution, the ink ductor roller 16 is moving from the left end to the right end. While the plate cylinder 2 is rotating for the second revolution or the fifth revolution, the ink ductor roller 16 is moving from the right end to the left end.

With this arrangement, if the ink ductor roller 16 comes into contact with the oscillating roller 15 located at the left end, the ink is transferred from the ink ductor roller 16 to the oscillating roller 15. The oscillating roller 15 to which the ink has been transferred opposes an ink distribution roller 17 to come into contact with it while moving to the right end side. Therefore, the amount of ink transferred to the circumferential surface of the ink distribution roller 17 gradually increases from the left end side to the right end side.

When the plate cylinder 2 rotates by two revolutions, the ink ductor roller 16 comes into contact again with the oscillating roller 15 which is moving from the right end to the left end, and the ink is transferred from the ink ductor roller 16 to the oscillating roller 15. The oscillating roller 15 to which the ink has been transferred opposes the ink distribution roller 17 to come into contact with it while moving to the left end side. Therefore, the amount of ink transferred to the circumferential surface of the ink distribution roller 17 gradually increases from the right end side to the left end side.

While the plate cylinder 2 rotates by four revolutions, the ink ductor roller 16 comes into contact with the oscillating roller 15 three times, and the ink is transferred from the ink ductor roller 16 to the oscillating roller 15. The oscillating roller 15 onto which the ink has been transferred moves to the right end once and then opposes the ink distribution roller 17 to come into contact with it while moving to the left end side. Therefore, the amount of ink transferred to the circumferential surface of the ink distribution roller 17 becomes substantially uniform in the axial direction of the ink distribution roller 17.

While the plate cylinder 2 rotates by six revolutions, the ink ductor roller 16 comes into contact with the oscillating roller 15 four times, and the ink is transferred from the ink ductor roller 16 to the oscillating roller 15. The oscillating roller 15 to which the ink has been transferred opposes the ink distribution roller 17 to come into contact with it while moving to the right end side. Therefore, the amount of ink transferred to the circumferential surface of the ink distribution roller 17 gradually increases from the right end side to the left end side.

According to the second embodiment, even if the oscillating roller 15 is reciprocally moved once during three revolutions, i.e., odd-numbered revolutions excluding one revolution, of the plate cylinder 2, and the ink ductor roller 16 is reciprocally moved once during two revolutions, i.e., even-numbered revolutions, of the plate cylinder 2, the amount of ink transferred to the circumferential surface of the ink distribution roller 17 becomes uniform in the axial direction of the ink distribution roller 17.

In the respective embodiments described above, the drive source for the swing motion of the ink ductor roller 16 and for the oscillation of the oscillating roller 15 is the drive motor serving as the drive source of the plate cylinder 2. However, a drive source for the ink ductor roller 16 and/or the oscillating roller 15 may be exclusively provided separately from this drive motor. In this case, if a control means that controls the rotation speed of the motor or the like serving as the drive source is provided, the adjusting operation of uniforming the amount of ink transferred to the circumferential surface of the ink distribution roller 17 in the axial direction of the ink distribution roller 17 can be performed while variously changing the periods of the swing motion of the ink ductor roller 16 and of the oscillating motion of the oscillating roller 15. As a result, the adjusting operation can be performed accurately within a short period of time.

In the respective embodiments described above, the ink ductor roller 16 is arranged between the ink fountain roller 10 and the oscillating roller 15. However, an upstream-side roller in the ink transfer direction may be defined as the oscillating roller 15, a downstream-side roller in the ink transfer direction may be defined as the oscillating roller 6, and the ink ductor roller 16 may be arranged at the position of the ink distribution roller 17. Similarly, the ink ductor roller 16 may be arranged at the position of the oscillating roller 6 or the left-end ink distribution roller 5 among the three ink distribution rollers 5. Various design changes can be made.

The period of motion of the oscillating roller 15 can be set different. Moreover, the periods of periodic motion of other oscillating rollers 6 and 3 can be set different. It suffices if the period of motion of at least one oscillating roller in the roller group is set different.

As has been described above, according to the present invention, once the gap between the ink blade and the circumferential surface of the ink fountain roller is adjusted to be constant throughout the entire length of the ink fountain roller in the axial direction, an ink density difference does not occur in the widthwise direction of the paper. Therefore, gap adjustment between the ink blade and the circumferential surface of the ink fountain roller need be performed only once, facilitating the adjusting operation while shortening the operation time.

Since the relationship between the ink density and the gap between the ink blade and the circumferential surface of the ink fountain roller becomes constant throughout the entire width of the paper without any change, optimum ink supply in accordance with the image can be performed based on data from the image area rate reading unit.

Furthermore, since the swing motion of the ink ductor roller and the oscillating motions of the oscillating rollers are performed by using the drive source that rotates the plate cylinder, a plurality of drive sources are not required, and the periods of the respective motions can be phase-locked.

What is claimed is:

1. An inking apparatus for a printing press, comprising:

an ink supplying unit having an ink fountain for storing an ink and an ink fountain roller having a circumferential surface on which a film of the ink supplied from said ink fountain is formed, said ink supplying unit being adapted to supply the ink on said circumferential surface of said ink fountain roller to an ink transfer line for a plate cylinder;

an ink form roller for supplying the ink, supplied from said ink supplying unit through said ink transfer line, to a plate mounted on said plate cylinder;

an oscillating roller disposed along said ink transfer line between said ink fountain roller and said ink form roller;

an ink ductor roller disposed between an upstream-side roller in an ink transfer direction to receive the ink and a downstream-side roller in the ink transfer direction to transfer the ink; and moving means for moving said oscillator roller axially through a reciprocal period and for moving said ink ductor roller between said upstream-side roller and said downstream-side roller through a reciprocal period and wherein said moving means ensures that the number of axially reciprocal periods of said oscillating roller is different than the number of reciprocal periods of said ink ductor roller.

2. An apparatus according to claim 1, wherein said moving means is further linked to said plate cylinder to radially move said plate cylinder through a rotational period, said moving means having structure to ensure that the reciprocal periods of said oscillating roller and said ink ductor roller are referenced to a rotational period of said plate cylinder.

3. An apparatus according to claim 2, said moving means having a mechanical linkage, said mechanical linkage axially moving said oscillating roller once through a reciprocal period for any particular even number of revolutions of said plate cylinder, and moving said ink ductor roller once through a reciprocal period for any particular odd number of revolutions of said plate cylinder.

4. An apparatus according to claim 2, wherein said moving means having a mechanical linkage, said mechanical linkage axially moving said oscillating roller once through a reciprocal period for any particular odd number of revolutions excluding the first revolution of said plate cylinder, and moving said ink ductor roller once through a reciprocal period for any particular even number of revolutions of said plate cylinder.

5. An apparatus according to claim 1, wherein said upstream-side roller in the ink transfer direction is said ink fountain roller, said downstream-side roller in the ink transfer direction is said oscillating roller.

6. An apparatus according to claim 1, wherein said moving means is further linked to said plate cylinder to radially move said plate cylinder through a rotational period and further comprising a first drive mechanism for converting rotational motion of said plate cylinder into reciprocal motion to drive said oscillating roller, and a second drive mechanism for converting the rotational motion of said plate cylinder into reciprocal motion to drive said ink ductor roller.

7. An apparatus according to claim 1, said ink fountain roller having a width and said ink supplying unit further comprising an ink blade operationally engaged with said ink fountain roller for uniformly adjusting a thickness of the film of the ink on said circumferential surface of said ink fountain roller in a widthwise direction over said ink fountain roller.

* * * * *